United States Patent [19]

Nault et al.

[11] Patent Number: 4,676,568

[45] Date of Patent: Jun. 30, 1987

[54] TERMINAL TEST PLUG

[75] Inventors: Gary F. Nault, Bloomington; Loren A. Singer, Minneapolis, both of Minn.

[73] Assignee: ADC Telecommunications, Inc., Minneapolis, Minn.

[21] Appl. No.: 831,641

[22] Filed: Feb. 21, 1986

[51] Int. Cl.[4] ..... H01R 29/00

[52] U.S. Cl. ..... 439/169; 439/482

[58] Field of Search ..... 339/31 R, 31 T, 108 TP

[56] References Cited

U.S. PATENT DOCUMENTS 4,151,462 4/1979 Teyler ..... 339/31 T 4,597,622 7/1986 Coe ..... 339/108 TP

*Primary Examiner*—Gil Weidenfeld

*Assistant Examiner*—Paula A. Austin

*Attorney, Agent, or Firm*—Merchant, Gould, Smith, Edell, Welter & Schmidt

[57] ABSTRACT

A test plug is disclosed for alternatively providing releasable electrical connection between a test lead and a first and second electrical contact where the first contact is a female contact and the second contact is a male contact. The plug includes a housing sized to be manually engageable and having a slot formed through a first end of the housing. A plunger is slidably disposed within the housing and slidable between an extended position and a retracted position with the plunger having a contact portion sized to extend through the slot and be received within the female contact when the plunger is in the extended position. The contact portion is further sized to be received within the housing when the plunger is in the retracted position with the slot being unobstructed to the insertion of a male contact. A first electrical contact point is disposed within the slot and yieldably biased into electrical connection with a male contact received within the slot. A conductor connects the first contact point to the test lead. The contact portion is provided with a deposit of electrically conductive material which is disposed to connect electrically with the female contact when the plunger is extended to the extended position with the electrically conductive material also in electrical contact with the first electrical contact point.

12 Claims, 12 Drawing Figures

FIG. 1
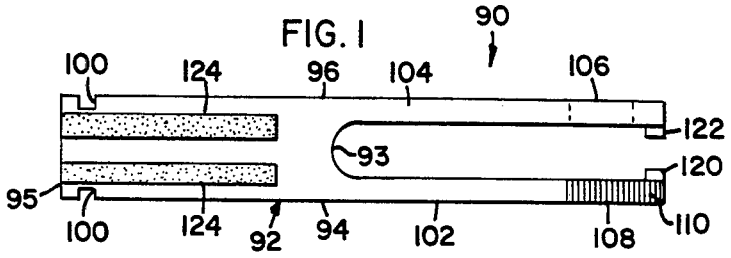
FIG. 3
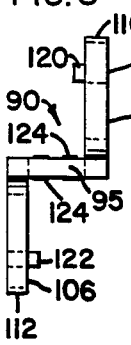
FIG. 2
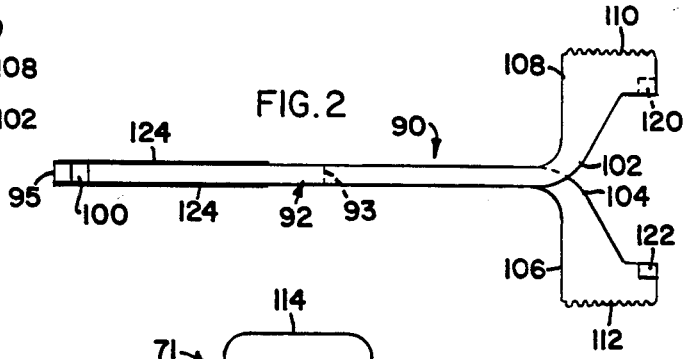
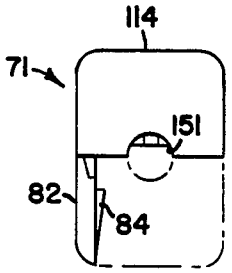
FIG. 6
FIG. 4
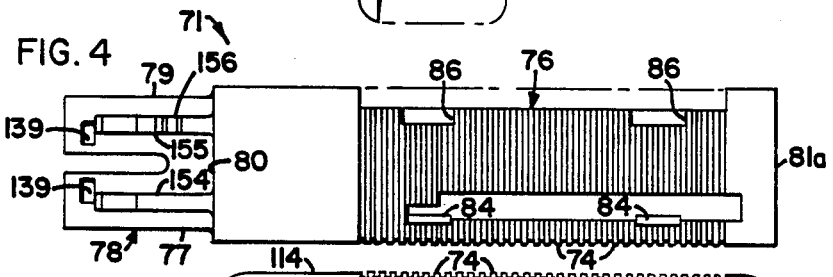
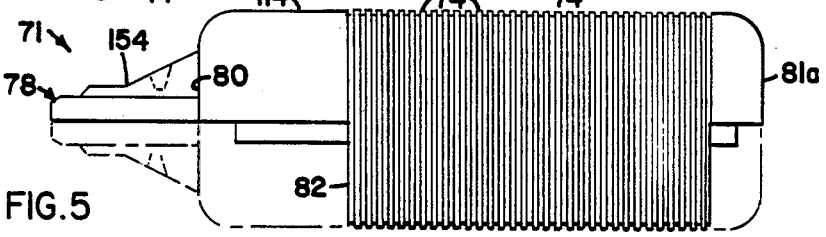
FIG. 5

TERMINAL TEST PLUG

BACKGROUND OF THE INVENTION

I. Field of the Invention

The present invention pertains to a test plug for use in testing equipment in the telecommunications industry. More particularly, the present invention pertains to a test plug and test assembly for testing electrical connections in a telecommunications terminal assembly.

II. Description of the Prior Art

In the prior art, terminal members in the telecommunications industry are well known for distributing or cross-connecting incoming telecommunication lines. An example of such is shown in commonly assigned and copending U.S. patent application Ser. No. 740,804 (now abandoned) which was filed on June 3, 1985 in the name of Loren A. Singer. The Singer application describes a U-shaped mounting bracket with individual terminals mounted on opposing tabs. The terminal is a block having two parallel opposing rows of wire connectors accessible through slots and apertures formed in the block. Shown best in FIGS. 4 and 5 of the Singer application, the opposing wire connectors or wire terminals (shown at 46) are electrically connected by a female electrical connection in the form of spring finger connectors identified by the numeral 50 in the application. A second female connector shown at numeral 68 and having a second pair of opposing spring finger connectors (shown at 68*a* and 68*d* in FIG. 5 of Singer) are disposed on a side of the first female connectors opposite the wire connectors 46. The second female connector 68 is electrically connected to a grounding strip 64. With the apparatus of Singer, telephone equipment lines and cross-connect lines are installed by placing the wire conductors within the split cylinder connectors 46.

As mentioned in the Singer application, telecommunication terminals are occasionally subjected to voltage or current surges which could damage equipment and present risk of harm to those in the vicinity of the equipment. As a result, such equipment is provided with an overload protection device. Shown at numeral 32 in the Singer patent application, the protection device includes a printed circuit board element 33 having its faces plated with a conductor pattern. The board element 33 is sized to be received within each of the first and second female connectors of the terminal. The conductor pattern on the circuit board element 33 includes conductor platings which would contact each of the spring finger connectors making up the female connectors. Opposite faces of the circuit board element 33 are electrically connected via plated-through holes such that the circuit board element 33 did not interrupt electrical connection between opposing spring finger connectors such as connectors 50 and 68*a* and 68*a* and 68*d* shown in FIG. 5 of the Singer patent application. The protection device includes a gas discharge element 140 which is electrically connected to the circuitry of the conductor platings. The gas discharge element together with the remainder of the circuitry of the overload protection device senses over-voltage conditions present on the conductors contacting the spring finger connectors 50 of the first female connector. In such an event, the circuitry of the protection device shunts the conductors to ground. In the Singer application, the end of the circuit board element 33 which is exposed includes electrical contact points on both faces of the circuit board which are in electrical contact with each of the spring finger connectors 50 of the first female connector.

As previously mentioned, telecommunication terminal blocks are provided with overload protectors for the safety of individuals as well as protection of the equipment. Another parameter for such equipment is the ability to occasionally test electrical connections between various wires entering the terminal. To this end, the art has developed test plugs which have contact elements which are inserted into the female connectors which are electrically connected to the wire terminals. The contact elements are in turn, electrically connected to a test lead which may transfer a signal from the female connectors to any one of a plurality of desired sources such as line mechanic's speaker phone or other connectors to provide cross-connects. An example of such a test plug is that manufactured by Krone GmbH of Berlin, Germany and described as Order No. 301,833 and 301,834 in the publication Krone "List of Equipment." As described in the Krone "List of Equipment", the test plugs of the prior art may have two or more contacts which are rigidly secured to a plug housing. The contacts are simply inserted into the female connectors of the terminal assemblies.

With prior art terminal assemblies provided with prior art overload protection devices, the protection device must be removed before the test plug can be inserted. As a result, during testing with such a plug, the equipment of the telecommunication terminal is not protected. This is particularly troublesome in terminal design where all of the connections within a particular terminal block are provided with an overload protector in the form of a magazine which covers the entire terminal block. An example of such a protector is shown as Order No. 301,811 in the aforesaid Krone "List of Equipment." This part is a magazine for a ten pair module such as module Order No. 301,221 shown in the publication. As a result, when a particular connection is being tested, not only is that particular connection deprived of its overload protector, but all other connections within the same block are deprived of an overload protector.

It would be desirable to provide a terminal assembly which simultaneously incorporates overload protection and means for permitting testing of electrical connections from time to time. It would also be desirable to provide such an assembly which is sufficiently versatile to permit testing of circuits with and without the presence of overload protectors. Finally, it would be desirable to provide such an assembly having assembly elements which are easy to use and easy to manufacture at low costs. However, such an assembly and elements have not been provided by the art.

OBJECTS AND SUMMARY OF THE INVENTION

It is an object of the present invention to provide a test plug for a telecommunications terminal which will test circuits within the terminal with or without the presence of an overload protector.

A further object of the present invention is to provide for a test plug which is easy to manufacture at reasonable cost and is easy to use.

According to a preferred embodiment of the present invention, a test plug is provided for alternatively providing electrical connection between a test lead and a female electrical contact in a terminal assembly and a male electrical contact exposed on an overload protector. The test plug of the present invention includes a housing sized to be manually engaged and defining and interior with a slot formed through an end of the housing. Slot defining surfaces of the housing are spaced apart sufficient for the exposed electrical contact of the protector device to be received within the slot. A plunger is slidably disposed within the housing and slidable between an extended position and a retracted position. The plunger has a contact portion sized to extend through the slot and be received within the female contacts of the terminal block when the plunger is in the extended position. The contact portion is further sized to be received within the housing when the plunger is in the retracted position. When the plunger is in the retracted position, the slot through the housing is unobstructed. An electrical contact is disposed within the slot and yieldably biased into electrical contact with the male contact which is received within the slot. The biased electrical contact is urged out of the slot when the plunger is moved into the extended position with the biased contact engaging a conductor disposed on the contact portion of the plunger. The contact portion on the plunger is further sized to be in contact with the female contacts of the terminal block when the contact portion is received within the female contact.

BRIEF DESCRIPTION OF THE DRAWINGS

FIG. 1 is a top plan view of a plunger for a test plug of the present invention;

FIG. 2 is a side view taken in elevation of the plunger of FIG. 1;

FIG. 3 is an end view taken in elevation of the plunger of FIG. 2;

FIG. 4 is a top plan view of a housing portion for the test plug of the present invention;

FIG. 5 is a side view taken in elevation of the housing portion of FIG. 4;

FIG. 6 is an end view taken in elevation of the housing portion of FIGS. 4 and 5;

DESCRIPTION OF THE PREFERRED EMBODIMENT

Figure 7:
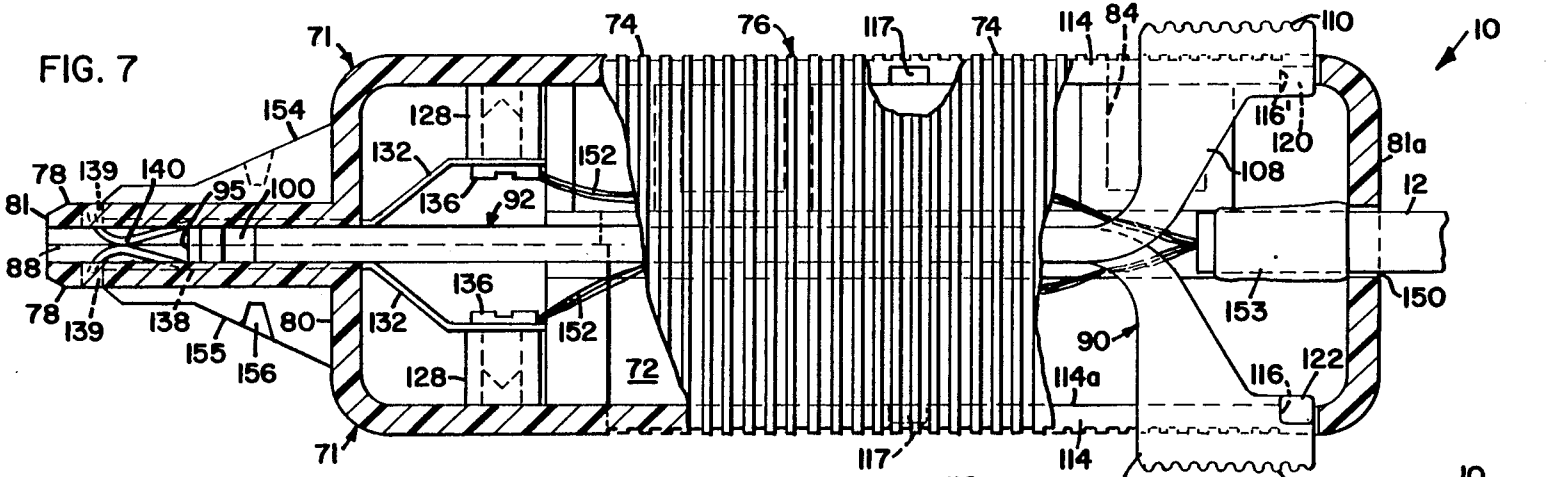
FIG. 7 is a side view taken in elevation and partly in section of an assembled test plug of the present invention showing a plunger in a retracted position.

Referring now to the drawings, a test plug 10 is disclosed for alternatively providing releasable electrical connection between a test lead 12 (shown in FIG. 7) and female electrical contacts 14 contained within a terminal block 16. Alternatively, the test plug 10 is used for providing a releasable electrical connection between the test lead 12 and male electrical contacts 17 of an overload protector 18. Since the test plug 10 of the present invention is intended for use with overload protector 18 and terminal block 16, a brief description of the overload protector 18 and terminal 16 will now be provided to facilitate understanding the structure of the test plug 10 as will be described later.

The terminal 16 for which the test plug 10 is intended in a preferred embodiment is a terminal such as that shown in greater detail in the aforementioned commonly assigned U.S. patent application Ser. No. 740,804 filed June 3, 1985 in the name of Loren A. Singer. The terminal 16 includes a body 20 shown in phantom lines in FIGS. 9–12 formed of insulative material and which houses a pair of parallel opposing rows of split cylinder connectors. As many as twenty connectors may occupy a row with the connectors grouped with a group consisting of two side-by-side connectors of a row and two opposing connectors of the other row. In the Figures, only a single group of four connectors is shown. Identified by numeral 22, each of the connectors is identical and include a cylindrical body portion 24 having a wire receiving end 26 and an electrical connection end 28. An axial slit 30 is formed through the body portion 24 extending from a wire receiving end 26 to electrical connection end 28. A wire termination blade 32 is provided at the wire receiving end 26 on a side thereof diametrically opposed to slit 30. It will be appreciated that such split cylinder connectors such as connector 22 are known in the art and are provided for telecommunication wires which consist of a conductive wire surrounded by insulation. The wires are connected to the split cylinder connectors 22 by means of placing the wire on top of wire receiving end 26 and aligned with the diameter of the body 24. The wire is urged into the connector 22 with the wire received within slit 30. As the wire is passed into slit 30, the slit defining edges of the body portion 24 pierce the wire insulation to provide electrical and mechanical connection between the wire and the connector 22. Excess wire is terminated by blade 32.

Figure 9:
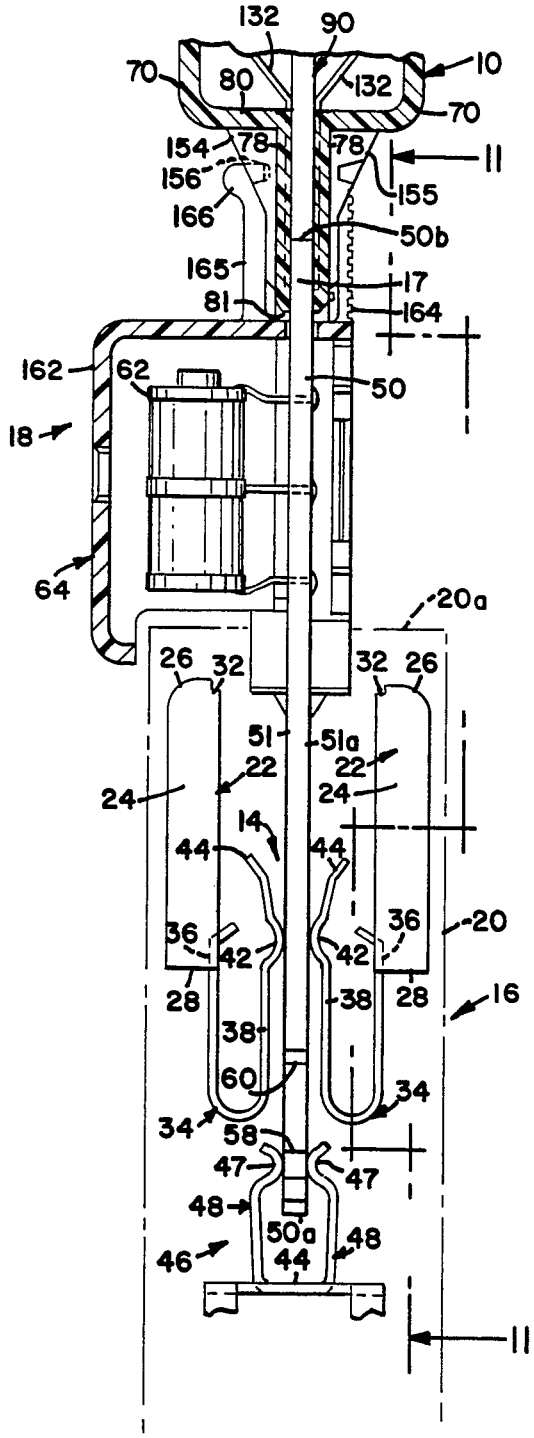
FIG. 9 is a side elevation view of an overload protector secured within a terminal block with a test plug of the present invention operably connected to the overload protector.
Figure 10:
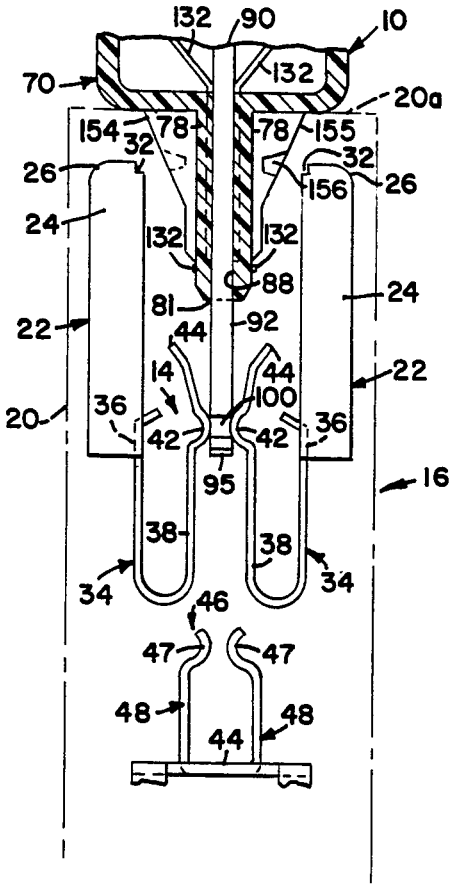
FIG. 10 is a side elevation view of the test plug of the present invention inserted within a terminal block.

Also housed within the terminal body 20 is a first female connection 14 which provides electrical connection between opposing split cylinder connectors 22 such as those shown in FIGS. 9 and 10. As shown, the female connector 14 comprises a pair of opposing contacts in the form of spring finger connectors 34. The spring finger connectors 34 have a first end 36 which is secured to the electrical connection end 28 of split cylinder connector 22. In cross section (as shown in FIGS. 9 and 10), the spring finger connectors 34 are generally U-shaped and terminate at a contacting finger 38. Shown best in FIGS. 11 and 12, legs 38 are provided with a split 40 separating the finger 38 into a first half **38*a* and a parallel spaced apart second half 38*b*. Each of halves 38*a* and 38*b* is provided with an outwardly buldging portion 42 opposing an opposite split cylinder connector. A free end 44 of the spring finger connectors flares outwardly away from bulge portion 42. As shown in FIGS. 9 and 10, the spring finger connectors on opposing split cylinder connectors 22 are aligned such that bulge portions 42 of the connectors 34 are in opposition. Additionally, the spring finger connectors 34 are provided with a resiliency such that in the absence of an obstruction between the opposing bulge portions 42, the bulge portions 42 will come into contact to provide electrical connection between opposing split cylinder connectors 22**.

Also shown in FIGS. 9–12, the termination block includes a grounding strip 44 running the length of the terminal body 20 and connected through any suitable means (not shown) to ground. Disposed adjacent each of the first female connectors 14 are second female connectors 46 which include a pair of spring finger connectors 48. Connectors 48 are similar to connectors 34 in that they have bulge portions 47 disposed in opposing relation. Second female connectors 46 are aligned with first female connectors 14 in linear alignment.

It will be appreciated that terminal blocks having a plurality of split cylinder connectors arranged in vertical parallel alignment and in opposing parallel rows such as described form no part of this invention per se. Additionally, female connectors such as first connector 14 and linearly aligned second connector 46 form no part of this invention per se, but are simply described so that the structure of the test plug 10 of the present invention may be described in its preferred embodiment.

In use with the present invention, an overload protector 18 is also provided. Overload protector 18 includes a printed circuit (PC) board element 50 in the form of a thin, narrow, elongated member having a first surface 51 and a second parallel spaced apart surface 51*a*. PC boards 50 for overload protectors 18 are not novel to the present invention and include plated-on conductors such as conductors 52, 54 and 56 disposed on surface 51 and shown in FIGS. 11 and 12. Each of conductors 52 and 56 extend from first contact ends 52*a* and 56*a*, respectively, to second contact ends 52*b* and 56*b*, respectively. PC board 50 is sized with a longitudinal dimension such that board 50 may be inserted within terminal body 20 with a first end 50*a* of board 50 disposed between opposing spring finger connectors 48. PC board 50 extends away from end 50*b* to an exposed free end 50*b* disposed spaced from a longitudinal edge 20*a* of terminal body 20.

Figure 11:
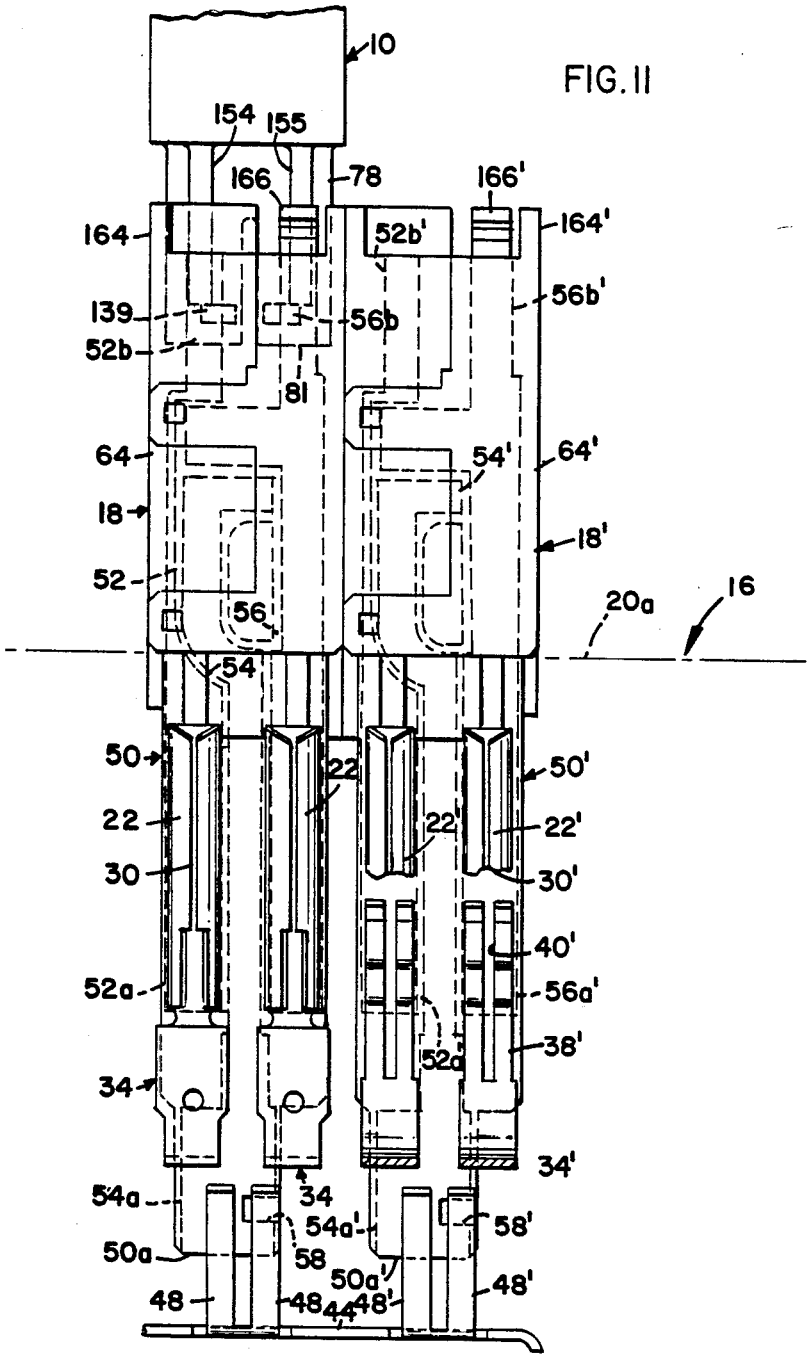
FIG. 11 is a front elevation view of the view of FIG. 9.

At end 50*a*, the printed circuit board 50 is provided with a notch 58 formed therethrough and aligned with opposing bulges 47 of the opposing fingers connectors 48. The bulges 47 are received within notch 58 to provide accurate positioning of the PC board 50. At end 50*a*, plated-on conductor 54 is provided with a first contact end 54*a* which is in electrical contact with the spring finger connectors 48. With PC board 50 in place as shown in FIGS. 9 and 11, first contact ends 52*a* and 52*b* oppose bulge portions 42 of spring finger connectors 34 in abutting relation.

Although not shown in the drawings, the second surface 51*a* of the PC board 50 also includes plated-on electrical conductors including conductors which are sized to extend from first ends opposing the bulge portions 42 of spring finger connectors 22. These conductors also extend to second ends at free end 50*b* of the PC element. On both surfaces of the PC element 50, the first and second ends of the plated-on conductors such as conductors 52 and 56 are in parallel and linear alignment such that the spacing between conductor ends 52*b* and 56*b* are the same as at ends 52*a* and 56*a*. Conductors on faces 51 and 51*a* are electrically connected by means of plated-through holes such as holes 60.

The overload protector 18 includes an overload protection element, in particular a gas over-voltage protection element of conventional type, which may be a gas discharge element 62 connected to the PC board 50. The circuitry of the PC board 50, of which gas discharge element 62 is a part, senses over-voltage conditions present on the conductors 52 and 56 and shunts the conductors to ground connector 54 in the event of overvoltage. It will be appreciated that the overload protector 18 in the form of a PC board 50 having conductors and a gas discharge element 62 as described forms no part of this invention per se and its method of operation is not necessary to understanding the structure and operation of the test plug of the present invention. However, it is important to note that the plated-on conductors of the PC element 50 provide electrical connection from their first contact points (such as contact points 52*a* and 56*a*) to the second contact points (52*b* and 56*b*) external of the terminal body 20 with the contact points on free end 50*b* on sides 51 and 51*a* being spaced apart a distance similar to the spacing between the bulge portions 42 of the spring finger connectors 34.

In order to electrically connect each of spring finger connectors 34 with a separate test lead to perform whatever test may be desired from time to time, a test plug 10 of the present invention is provided. Additionally, a novel housing 64 is provided surrounding the free end 50*b* of printed circuit element 50 to facilitate use of the test plug 10 with the overload protector 18 in a manner as will be described.

Figure 8:
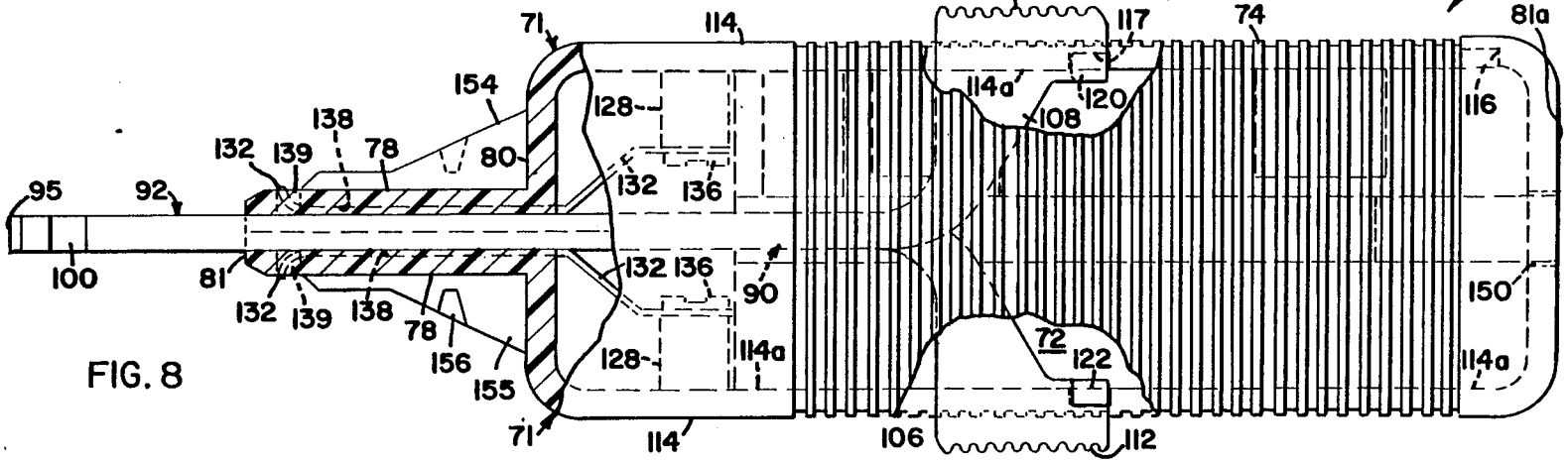
FIG. 8 is the view of FIG. 7 showing the plunger in an extended position.

Referring now to FIGS. 1–8, the test plug 10 of the present invention is shown. FIGS. 7 and 8 show the test plug 10 in an assembled position. As shown, the test plug 10 includes a housing 70 which defines a plug interior 72. The housing 70 is formed from two identical housing halves 71 the elements of which are numbered identically. FIGS. 4, 5 and 6 show a housing half 71 in a top plan view, side elevation view and end elevation view, respectively. In FIGS. 4–6, the position of a second half is shown in phantom lines to suggest the outside dimensions of a completed housing.

As shown in FIGS. 4–8, the housing 70 is sized to be manually engageable and has a plurality of parallel aligned ridges 74 surrounding its body portion 76 to facilitate gripping of the body portion 76 by an operator. Each body half 71 has an insert plate 78 which extends generally perpendicular to a forward end 80 of housing 70. A side wall 82 of the body half 71 has a pair of latch clips 84 (shown best in FIG. 6) which are sized to be received within opposing clip receiving notches 86 (FIG. 4) of a joining housing half 71 to define the completed housing 70.

With housing halves 71 joined, opposing plates 78 are spaced apart a distance to define a slot 88 extending between opposing plates 78 and through end wall 80 into interior 72. The spacing of the opposing slot defining surfaces of plates 78 is such that the difference between the surfaces is approximately equal to the thickness of PC board 50 measured between faces 51 and 51*a*. The width of the slot 88 from side edge 77 to side edge 79 (as shown in FIG. 4) is approximately equal to the width of the PC board 50 as measured between its side edge 53 and second side edge 55.

A plunger 90 is provided slidably disposed within the housing interior 72. Shown separately in FIGS. 1–3, the plunger 90 includes a flat contact portion 92 extending from a base end 93 to a free end 95. Contact portion 92 is sized to have a thickness and width generally equal to that of the thickness and width of the PC board 50 such that contact portion 92 may be slidably received within slot 88. Side edges 94 and 96 of the contact portion 92 are provided with reliefs 100 adjacent free end 95. A pair of prongs 102, 104 disposed in linear alignment with edges 94 and 96, respectively, extend away from edge 93 and terminate at raised narrow plunger ends 106 and 108. Plunger ends 106 and 108 are each provided with narrow ridged surfaces 110 and 112, respectively, with the distance between surfaces 110 and 112 being greater than the distance between opposing sides 114 of joined housing halves 71.

As shown in FIG. 4, each of the housing halves includes an elongated slot 118 which has a width generally equal to the narrow width of plunger ends 106 and 108. Slots 118 extend in a longitudinal direction generally parallel to a direction of slide of plunger 90 as will be described.

As shown in FIGS. 7 and 8, plunger 90 is disposed within the interior 72 of housing 70 with surfaces 110 and 112 projecting through slots 118. Contact portion 92 extends centrally through the interior 72 of housing 70 with free end 95 received within slot 88. Each of plunger ends 106 and 108 is provided with inwardly projecting tabs 120 and 122, respectively, and disposed to be adjacent interior surfaces 114*a* of upper and housing walls 114. Each of surfaces 114*a* is provided with a pair of spaced apart notches 116 and 117 shaped to conform with the exterior shape of tabs 120 and 122. The distance between notches 116 and 117 is selected to be the distance of a desired stroke of plunger 90 between a retracted position as shown in FIG. 7 and an extended position as shown in FIG. 8.

By engaging surfaces 110 and 112, an operator can force the surfaces toward one another such that tabs 120 and 122 are cleared from notches 116. At this point, the plunger 90 can be moved to the extended position with the operator releasing the grip on surfaces 110 and 112 with the resiliency of the cantilevered prongs 102 and 104 urging tabs 120 and 122 into notches 117. Retraction of the plunger 90 to the fully retracted position (as shown in FIG. 7) is performed in the exact opposite manner.

As shown in FIGS. 7 and 8, the contact portion 92 is sized to have a length such that the free end 95 is exposed exterior of housing 70 when the plunger is in the extended position of FIG. 8. When in the retracted position, the free end 95 is spaced from end 81 of plates 78 thereby providing unobstructed slot 88. The contact portion 92 is sized such that the distance between end wall 80 and aligned reliefs 100 is generally equal to a distance between the top surface 20*a* of terminal block 20 and bulge portions 42 of the first female connector 14.

Shown best in FIGS. 1–3, the plunger 90 is provided with a pair of parallel conductor strips 124 on both sides of contact portion 92. Conductor strips 124 are preferably disposed on non-conductive contact portion 92 by depositing a conductive metal (such as copper) onto contact portion 92 through a commercially available process whereby contact portion 92 is masked to expose only the desired location of strips 124 and the copper is applied through an additive process. Strips 124 are disposed on contact portion 92 in spaced apart parallel alignment with the spacing equal to the spacing of adjacent spring finger connectors 34 of the first female connector 14.

Referring now to FIGS. 4, 7 and 8, each of housing halves 71 is provided with a pair of cylindrical posts 128. The posts 128 are disposed within the interior 72 and each support a separate conductive metal clip 132. Clips 132*a* are secured to posts 128 through any suitable means such as screws 136. The clips extend into slot 80 with the plate 78 opposing a clip being provided with a groove 138 and opening 139 sized to receive the clip 132. As shown in FIG. 7, clip 132 is provided with a bulge portion 140 with opposing clips 132 disposed such that opposing bulges are urged toward one another. As shown in FIG. 8, when the plunger 90 is moved to its extended position, the contact portion 92 of the plunger 90 urges the clips 132 against their natural resilience into grooves 138 with free ends of the clips 132 extending through openings 139. The clips 132 are disposed in parallel alignment on both sides of the contact portion 92 such that each of clips 132 is uniquely associated with and in electrical contact with one of the elongated strips 124 on contact portion 92 when plunger 90 is in the extended position.

A four wire test lead 12 extends through an opening 150 defined by semi-circular notches 151 formed in the end wall 81*a* of housing 70 (shown in FIG. 6). Four wires 152 extend from test lead 12 to each of clips 132 and is uniquely secured to clip 132 in any suitable manner. To retain test lead 12 within housing 70, a cylindrical piece of heat shrink material 153 is disposed surrounding test lead 12 on a side thereof in the interior 72. The material is heat shrunk onto test lead 12 and prevents test lead 12 from being pulled out of housing 70.

Finally, the structure of test plug 10 includes a pair of support gussets 154 and 155 on each of plates 78 extending generally perpendicular to plate 78 and end wall 80. Gusset 155 includes a notched relief 156 the function of which will be described later.

Figure 12:
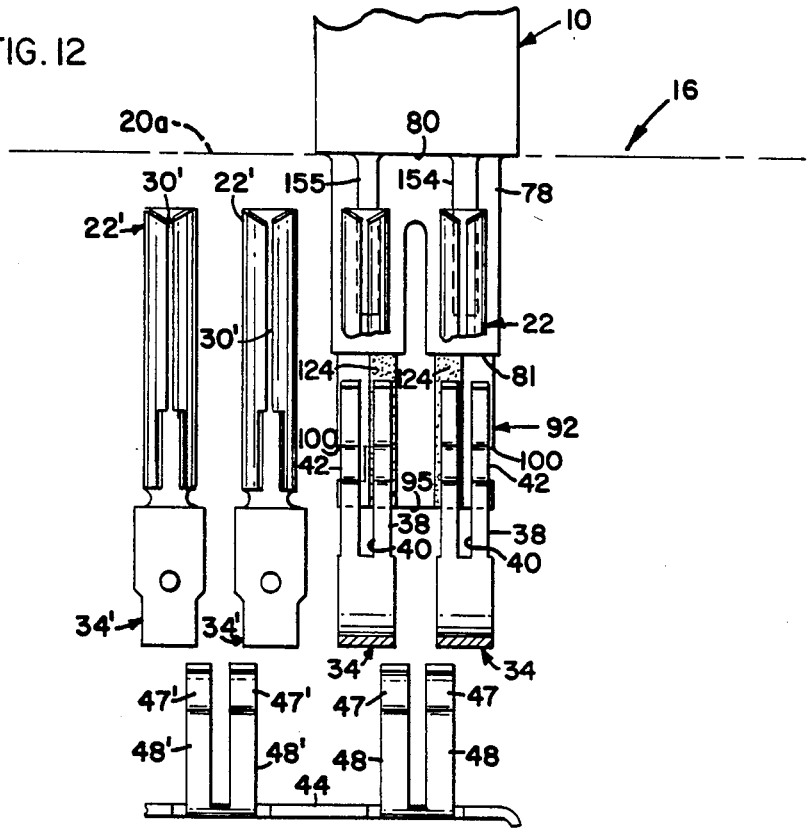
FIG. 12 is a frontal view taken in elevation of the view of FIG. 10.

Having described the structure of test plug 10, it can be seen how the test plug 10 can be used to provide unique electrical connection between each of the wires 154 of test lead 12 and the spring finger connectors 34 of first female connector 14. As shown in FIGS. 10 and 12, plunger 90 is moved to its fully extended position and inserted within terminal body 20 with first end 80 abutting end 20*a* of body 20. So disposed, contact portion 92 of plunger 90 projects between opposing spring finger connectors 34 with reliefs 100 receiving opposing bulge portions 42 to secure the test plug 10 in position. Also, the bulge portions 42 contact opposing conductor strips 124. In the extended position, the biasing of clips 132 urge them against strips 124 such that there is a continuous electrical connection between each of the spring finger connectors 34 and one of the wires 152 of test lead 12.

If it is desired to use test plug 10 to place the wires 152 of test lead 12 in contact with the spring finger connectors 34 while the overload protector 18 is in use, the test plug 10 is modified by retracting the plunger 90 to the fully retracted position shown in FIG. 7. So retracted, the plunger no longer urges clips 132 within grooves 138. Accordingly, the clips 132 may spring back into slot 88. With the clips 132 disposed within slot 88, the test plug 10 is urged over the male contact 17 at free end 50*b* of PC element 50 as shown in FIGS. 9 and 11. (For comparison, FIG. 11 shows a protector 18 with a plug 10 as well as a protector 18' without a plug. The element of protector 18' and its associated connectors are numbered identically as those of protector 18 with the addition of apostrophes.) Each of the four clips 132 are in unique electrical contact with the second ends 51*b* and 56*b* of the plated-on conductors on both sides 51 and 51*a* of PC board 50. Likewise, the first ends 52*a* and 56*a* of the plated-on conductors of the PC board 50 are in unique electrical contact with each of the four spring finger connectors 34. As a result, each of the spring finger connectors 34 is in unique electrical connection with one of the four wires 152 of test lead 12.

To retain test plug 10 in a fixed position while it is being used with the overload protector 18, the overload protector 18 is provided with a novel housing 64 exterior of terminal block 20. Housing 64 includes a main body portion 162 which surrounds gas discharge element 62 and a portion of the exposed PC board element 50. Male connector portion 17 at the free end 50*b* of the PC board 50 extends through housing portion 162. The male connector portion is surrounded by a protective shield 164 with surfaces of shield 164 spaced away from surfaces of the PC board 50 a distance sufficient to permit entry of plates 78 with the PC board 50 disposed between opposing plates 78 as shown in FIG. 9. A portion of the protective shield 164 is a cantilevered clip 165 having a clip end 166 sized to be received within notch 156 formed in gussets 155. With the cantilevered clip 165 secured within gussets 155, the test plug 10 is retained in electrical contact leaving an operator's hands free for other work.

From the foregoing, it can be seen how the objects of the present invention have been attained in a preferred manner. The test plug of the present invention is adaptable such that it may be used to provide electrical contact between the four wires 152 of the test lead 12 and the female electrical contacts 14 within the terminal body 20. Alternatively, the test plug 10 may be modified such that it could be used to provide electrical contact between the wires 152 of test lead 12 and the male connector 17 at end 50*b* of printed circuit board 50. So connected, due to the structure of the printed circuit board, the wires 152 of test lead 12 are still in discreet individual contact with each of the spring finger connectors 34 of the female connector 14. As a result, the test plug 10 may be used to provide testing of electrical contacts with or without the use of overload protector 18 thereby enhancing its versatility and increasing the safety factor for the telecommunication equipment. While the foregoing description has described a test plug connector having four contact strips 124 to provide electrical connection between four spring finger connectors 34 and four wires 151 of test lead 150, it will be appreciated that the present invention can readily be adapted for other configurations such as providing electrical connection between two wires of a test lead and two connections within a terminal block assembly. These and other modifications and equivalents of the disclosed concepts such as readily occur to those skilled in the art are intended to be included in the scope of this invention. Thus, the scope of this invention is intended to be limited only by the scope of the claims as are or may hereafter be appended hereto.

What is claimed is:

1. A test plug for alternatively providing releasable electrical connection between a test lead and a first and second electrical contact wherein said first contact is a female contact of predetermined size and said second contact is a male contact of predetermined size, said plug comprising:

a housing sized to be manually engageable and defining an interior with a slot formed through an end of said housing in communication with said interior, slot defining surfaces of said housing being spaced apart for said male electrical contact to be received within said slot between said slot defining surfaces;

a plunger slidably disposed within said housing interior and slidable between an extended position and a retracted position, said plunger having a contact portion sized to extend through said slot and be received within said female contact when said plunger is in said extended position and sized to be received within said housing when said plunger is in said retracted position with said slot being unobstructed to insertion of said male contact;

a first electrical contact point disposed within said slot with means for yieldably biasing said first point into electrical connection with a male contact received within said slot and with said first point movable out of said slot when said plunger is moved into said extended position with said biasing means urging said first point into contact with said contact portion of said plunger;

conductor means for electrically connecting said first contact point with said test lead; and conductive material disposed on said plunger contact portion and sized to contact said female contact in electrical connection when said contact portion is received within said female contact and with said conductive material in electrical connection with said first contact point when said plunger is in said extended position.

2. A test plug according to claim 1 wherein said plunger is provided with a latch member sized to be received within a first conforming surface formed in said housing and corresponding to said retracted position, and a second conforming surface when in said extended position; means for yieldably biasing said latch member toward said conforming surfaces and means for engaging said latch member and urging it against said biasing means to release the latch member and move it between the first and second conforming surfaces with said plunger moving between said retracted and extended positions.

3. A test plug according to claim 1 wherein said plunger includes a pair of cantilevered prongs extending from said contact portion with each of said cantilevered prongs terminating at a latch member on opposite sides of said contact portion with the latch member including tabs sized to engage tab receiving notches formed in opposing surfaces of said housing, said housing having elongated slots sized to expose engageable surfaces of said latch members with said slots extending in a direction generally parallel to a direction of travel of said plunger.

4. A test plug according to claim 1 wherein said female contact includes a connector clip member biased toward said contact portion and having a protruding surface sized to be received within a relief formed within said contact portion to releasably hold said contact portion.

5. A test plug according to claim 1 wherein said plunger is formed of electrically insulative material having an electrically conductive material deposited on said insulative material and extending in a generally linear path in parallel alignment with a direction of travel of said plunger moving between said extended and retracted positions.

6. A test plug according to claim 5 comprising a resilient electrically conductive member having a first end secured within said housing and electrically connected to said test lead, said electrically conductive member having a second end disposed within said slot to engage said male contact in electrical connection when said male contact is disposed within said slot; said resilient member opposing a slot defining surface having a groove formed therein sized to receive said resilient member when said member is urged into said groove as said plunger is moved to said extended position with resilience of said member urging said resilient member into electrical contact with said conductive material disposed on said plunger.

7. A test system for a distribution terminal having a plurality of paired wire connectors electrically connected by a first female connector having a first pair of opposing electrical contacts yieldably urged toward one another in electrical contact, said system comprising:

an overload protector having an exposed end sized to be removably received between said opposing pairs of electrical contacts and said protector terminating at a housed end; a pair of first conductor contacts secured to said exposed end and disposed thereon for one of said first conductor contacts to electrically connect a first of said first pair of electrical contacts and a second of said first conductor contacts disposed to electrically contact a second of said first pair of electrical contacts; said overload protector having a pair of second conductor contacts disposed on said housed end on a male connector of predetermined size;

a test plug for alternatively providing releasable electrical connection between a test lead and either of said first female connectors and said male connector, said test plug having a housing sized to be manually engageable and defining an interior with a slot formed through and end of said housing in communication with said interior; slot defining surfaces of said housing spaced aapart a distance sufficient for said male connector to be received within said slot;

a plunger slidably disposed within said housing interior and slidable between an extended position and a retracted position; said plunger having a contact portion sized to extend through said slot and be received within said female connector when said plunger is in said extended position and sized to be received within said housing when said plunger is in said retracted position with said slot being unobstructed to insertion of said male connector;

a first pair of electrical test contacts disposed within said slot with means for yieldably biasing each of said test contacts into electrical connection with a second conductor contact on said male connector when said male connector is received within said slot, said test contacts urged out of said slot when said plunger is moved into said extended position with said biasing means urging said test contacts into contact with said contact portion;

conductor means for electrically connecting said test contacts with said test lead; and a pair of electrically conductive material deposits disposed on said plunger contact portion to electrically contact each of said first pair of connectors of said female connector in electrical connection when said contact portion is received within said female connector and with said deposits in electrical connection with said first pair of electrical test contacts.

8. A test system according to claim 7 wherein said plunger is provided with a latch member sized to be received within a first conforming surface formed in said housing and corresponding to said retracted position, and a second conforming surface when in said extended position; means for yieldably biasing said latch member toward said conforming surfaces and means for engaging said latch member and urging it against said biasing means to release the latch member and move it between the first and second conforming surfaces with said plunger moving between said retracted and extended positions.

9. A test system according to claim 7 wherein said plunger includes a pair of cantilevered arms extending from said contact portion with each of said cantilevered arms terminating at a latch member on opposite sides of said contact portion with the latch member including tabs sized to engage tab receiving notches formed in opposing surfaces of said housing, said housing having elongated slots sized to expose engageable surfaces of said latch members with said slots extending in a direction generally parallel to a direction of travel of said plunger.

10. A test system according to claim 7 wherein said female contact includes a connector clip member biased toward said contact portion and having a protruding surface sized to be received within a relief formed within said contact portion to releasably hold said contact portion.

11. A test assembly according to claim 7 wherein said plunger is formed of electrically insulative material having an electrically conductive material deposited on said insulative material and extending in a generally linear path parallel aligned with a direction of travel of said plunger and moving between said extended and retracted positions.

12. A test system according to claim 11 comprising a resilient electrically conductive member having a first end secured within said housing and electrically connected to said test lead, said electrically conductive member having a second end disposed within said slot to engage said male contact in electrical connection when said male contact is disposed within said slot; said resilient member opposing a slot defining surface having a groove formed therein sized to receive said resilient member when said member is urged into said groove as said plunger is moved to said extended position with resilience of said member urging said resilient member into electrical contact with said conductive material disposed on said plunger.

* * * * *